US011549264B2

(12) United States Patent
Li et al.

(10) Patent No.: US 11,549,264 B2
(45) Date of Patent: Jan. 10, 2023

(54) JOINT ASSEMBLY FOR TRUSS BOTTOM PLATE, TRUSS OF ESCALATOR OR PASSENGER CONVEYOR

(71) Applicants: KONE Elevators Co., Ltd., Jiangsu (CN); KONE CORPORATION, Helsinki (FI)

(72) Inventors: Lichun Li, Kunshan (CN); Fuqiang Zhang, Kunshan (CN); Hongfei Zhou, Kunshan (CN); Xiang Gao, Kunshan (CN)

(73) Assignees: KONE ELEVATORS CO., LTD., Jiangsu (CN); KONE CORPORATION, Helsinki (FI)

( * ) Notice: Subject to any disclaimer, the term of this patent is extended or adjusted under 35 U.S.C. 154(b) by 0 days.

(21) Appl. No.: 17/378,868

(22) Filed: Jul. 19, 2021

(65) Prior Publication Data

US 2022/0018132 A1 Jan. 20, 2022

(30) Foreign Application Priority Data

Jul. 20, 2020 (CN) ..... 202010701622.2

(51) Int. Cl.
*E04C 3/06* (2006.01)
*B66B 21/02* (2006.01)
*B66B 23/00* (2006.01)

(52) U.S. Cl.
CPC ..... *E04C 3/06* (2013.01); *B66B 21/02* (2013.01); *B66B 23/00* (2013.01)

(58) Field of Classification Search
CPC ..... E04C 3/06; B66B 21/02; B66B 23/00; B66B 21/10
See application file for complete search history.

(56) References Cited

U.S. PATENT DOCUMENTS 4,811,829 A * 3/1989 Nakazawa ..... B66B 23/00 403/14
4,832,169 A * 5/1989 Goto ..... B65G 21/02 53/446

(Continued)

FOREIGN PATENT DOCUMENTS

CN 106337999 A 1/2017
EP 2 751 008 B1 7/2015

(Continued)

OTHER PUBLICATIONS

Extended European Search Report for European Application No. 21185968.1, dated Nov. 18, 2021.

*Primary Examiner* — Rodney Mintz
(74) *Attorney, Agent, or Firm* — Birch, Stewart, Kolasch & Birch, LLP

(57) ABSTRACT

A joint assembly for a truss bottom plate, the truss bottom plate includes a first bottom plate and a second bottom plate adjacent to each other, and a gap exists at an adjacent position between the first bottom plate and the second bottom plate; the joint assembly includes a first barrier plate and a second barrier plate; the first barrier plate is connected with the first bottom plate; the second barrier plate is connected with the second bottom plate; a part of the first barrier plate is arranged to overlap a part of the second barrier plate and cover the gap. A truss of an escalator or a passenger conveyor, the truss of the escalator or the passenger conveyor includes the joint assembly as described above.

11 Claims, 7 Drawing Sheets

(56) References Cited

U.S. PATENT DOCUMENTS

| | | | | |
|---|---|---|---|---|
| 4,958,473 | A * | 9/1990 | Iyoda | E04B 1/2403 198/860.3 |
| 6,814,215 | B2 * | 11/2004 | Krampl | B66B 23/00 198/321 |
| 9,676,597 | B2 * | 6/2017 | Senger | B66B 23/14 |
| 10,053,335 | B2 * | 8/2018 | González Pantiga | B66B 23/00 |
| 10,150,650 | B2 * | 12/2018 | Illedits | B65G 21/02 |
| 10,562,741 | B2 * | 2/2020 | Eder | B66B 21/00 |
| 10,683,193 | B2 * | 6/2020 | Liu | B66B 23/00 |
| 2002/0175039 | A1 * | 11/2002 | Fargo | B66B 23/00 198/336 |
| 2003/0116402 | A1 * | 6/2003 | Krampl | B66B 23/00 198/321 |
| 2012/0168277 | A1 * | 7/2012 | Senger | B66B 23/14 198/321 |
| 2016/0376128 | A1 * | 12/2016 | González Pantiga | B66B 23/00 198/321 |
| 2018/0319631 | A1 * | 11/2018 | Illedits | B65G 21/02 |
| 2019/0322492 | A1 * | 10/2019 | Eder | B66B 21/10 |
| 2019/0367332 | A1 * | 12/2019 | Liu | B66B 23/00 |
| 2022/0089413 | A1 * | 3/2022 | Salojärvi | B66B 23/14 |
| 2022/0145610 | A1 * | 5/2022 | Krampl | E04C 3/08 |

FOREIGN PATENT DOCUMENTS

| | | | |
|---|---|---|---|
| JP | 2005-290893 | A | 10/2005 |
| JP | 5066057 | B2 | 11/2012 |

* cited by examiner

JOINT ASSEMBLY FOR TRUSS BOTTOM PLATE, TRUSS OF ESCALATOR OR PASSENGER CONVEYOR

TECHNICAL FIELD

The present disclosure relates to a joint assembly for a truss bottom plate of a truss of an escalator or a passenger conveyor. The present disclosure further relates to a truss of an escalator or a passenger conveyor, the truss of the escalator and or the passenger conveyor including the joint assembly.

BACKGROUND

In the prior art, a truss bottom plate is supported by a truss of an escalator or a passenger conveyor, and the truss bottom plate includes a first bottom plate and a second bottom plate which are adjacent to each other, and a gap exists at the adjacent position between the first bottom plate and the second bottom plate. At present, when connecting the first bottom plate and the second bottom plate on site, it is necessary to fill the gap with sealant, which is time-consuming and expensive. Sometimes even forgetting the sealing work, it may be dangerous to leak lubricating oil from the gap. In order to reduce the risk of oil leakage, the quality of sealant (sealant will age and deteriorate with time) is very important for sealing joints, so the material cost is very high.

SUMMARY

In order to solve the above-mentioned one or more defects in the prior art, according to one aspect of the present disclosure, a joint assembly for a truss bottom plate of a truss of an escalator or a passenger conveyor is proposed. The truss bottom plate includes a first bottom plate and a second bottom plate adjacent to each other, and a gap exists at an adjacent position between the first bottom plate and the second bottom plate.

The joint assembly includes a first barrier plate and a second barrier plate.

The first barrier plate is connected with the first bottom plate.

The second barrier plate is connected with the second bottom plate.

A part of the first barrier plate is arranged to overlap a part of the second barrier plate and cover the gap.

According to the above aspect of the present disclosure, the first barrier plate is a bent sheet metal member and includes a first barrier plate first portion, a first barrier plate second portion, a first barrier plate third portion and a first barrier plate fourth portion.

The first barrier plate first portion is connected with the first bottom plate.

The first barrier plate second portion is connected between the first barrier plate third portion and the first barrier plate first portion and is inclined relative to the first barrier plate third portion and the first barrier plate first portion.

The first barrier plate fourth portion is bent from an edge of the first barrier plate third portion towards the second barrier plate.

According to the above aspects of the present disclosure, the second barrier plate is a bent sheet metal member and includes a second barrier plate first portion and a second barrier plate second portion.

The second barrier plate second portion is bent relative to the second barrier plate first portion.

The second barrier plate first portion is connected with the second bottom plate.

A width of the second barrier plate second portion is smaller than a width of the second barrier plate first portion.

According to the above aspects of the present disclosure, the first barrier plate fourth portion extends toward a bent opening between the second barrier plate first portion and the second barrier plate second portion.

The bent opening is open towards a direction away from the gap.

According to the above aspects of the present disclosure, in a length direction of the second barrier plate, two ends of the second barrier plate are respectively connected with a truss for supporting the truss bottom plate by welding.

The first barrier plate first portion is connected with the first bottom plate by welding or integrally formed with the first bottom plate.

The second barrier plate first portion is connected with the second bottom plate by welding or integrally formed with the second bottom plate.

According to the above aspects of the present disclosure, the joint assembly further includes an oil guide plate.

The oil guide plate includes an oil guide plate first portion and an oil guide plate second portion that are bent in an L shape relative to each other.

The oil guide plate first portion is connected with the truss of the escalator or the passenger conveyor and the first bottom plate by welding respectively.

The oil guide plate second portion is connected with the first bottom plate by welding.

In a length direction of the first barrier plate, two ends of the first barrier plate are respectively connected with the oil guide plate second portion by welding.

According to the above aspects of the present disclosure, the oil guide plate further includes an oil guide plate notch arranged in the oil guide plate second portion.

In a length direction of the second barrier plate, two ends of the second barrier plate pass through the oil guide plate notch.

According to the above aspects of the present disclosure, the oil guide plate further includes a connection stud arranged on the oil guide plate second portion.

According to the above aspects of the present disclosure, the joint assembly further includes an oil barrier plate.

The oil barrier plate is connected to the truss of the escalator or the passenger conveyor and positioned above the first barrier plate and the second barrier plate, so as to cover the gap.

Specifically, the oil barrier plate includes an oil barrier plate body and an oil barrier plate first portion, an oil barrier plate second portion and an oil barrier plate third portion which are bent and extended relative to the oil barrier plate body.

The oil barrier plate second portion is connected to the truss by welding.

The oil barrier plate first portion is L-shaped relative to the oil barrier plate third portion, so that the oil barrier plate first portion and the oil barrier plate third portion are respectively matched on the edges of the oil guide plate second portion and the oil guide plate first portion which are L-shaped.

A length of the oil barrier plate first portion is equal to a length of the oil guide plate second portion.

At two ends of the second barrier plate in a length direction, the oil barrier plate body covers the gap between the truss and the oil guide plate second portion.

According to the above aspects of the present disclosure, an oil barrier plate notch is arranged on the oil barrier plate first portion.

When the oil barrier plate is match on the oil guide plate, the connection stud passes through the oil barrier plate notch, so that the oil barrier plate can be fixed on the oil guide plate through a matching of a fastening nut and the connection stud.

According to another aspect of the present disclosure, a truss of an escalator or a passenger conveyor is provided. The truss of the escalator or the passenger conveyor includes the joint assembly as described above.

According to the joint assembly of the present disclosure, the first barrier plate and the second barrier plate are both bent sheet metal members and are oil-tight welded with the truss. The oil barrier plate is also a bent sheet metal member fixed on the truss. By combining the first barrier plate and the second barrier plate with height difference into a lap joint type, lubricating oil can flow along the surface of the first barrier plate to the bottom of the elevator, while the second barrier plate can prevent the backflow of lubricating oil, thereby preventing the leakage of lubricating oil from the gap. The oil barrier plate can prevent leakage of lubricating oil dripping from the upper chain from the gap. According to the present disclosure, the joint assembly has no risk of oil leakage; sealant is not needed; and there is no aging problem of sealant. In addition, the installation work of truss soffit connection is reduced.

So far, in order that the detailed description of the present disclosure can be better understood and the contribution of the present disclosure to the prior art can be better recognized, the present disclosure has summarized the content of the present disclosure quite broadly. Of course, embodiments of the present disclosure will be described below and will form the subject matter of the appended claims.

Likewise, those skilled in the art will recognize that the concepts on which the present disclosure is based can be easily used as a basis for designing other structures, methods and systems for carrying out several purposes of the present disclosure. Therefore, it is important that the appended claims should be considered to include such equivalent structures as long as they do not go beyond the spirit and scope of the present disclosure.

BRIEF DESCRIPTION OF THE DRAWINGS

Those skilled in the art will have a better understanding of the present disclosure through the following drawings, and the advantages of the present disclosure can be more clearly reflected. The drawings described herein are only for illustrative purposes of selected embodiments, not all possible implementations and are intended not to limit the scope of the present disclosure.

DETAILED DESCRIPTION

With reference to FIGS. 1 to 7, specific embodiments according to the present disclosure will be described in detail below.

Figure 1:
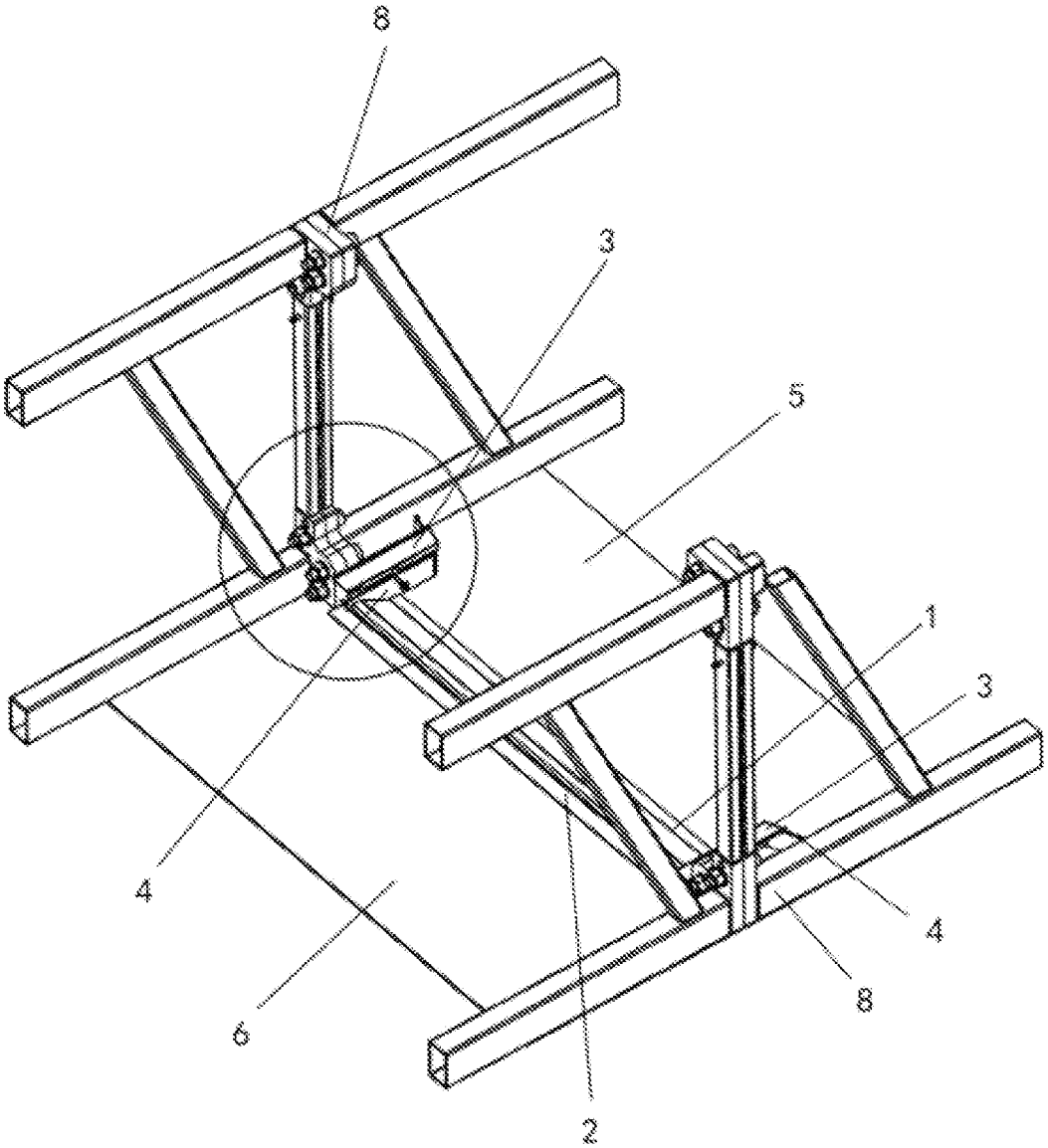
FIG. 1 illustrates a perspective view of a truss of an escalator or a passenger conveyor having a joint assembly according to the present disclosure.
Figure 2:
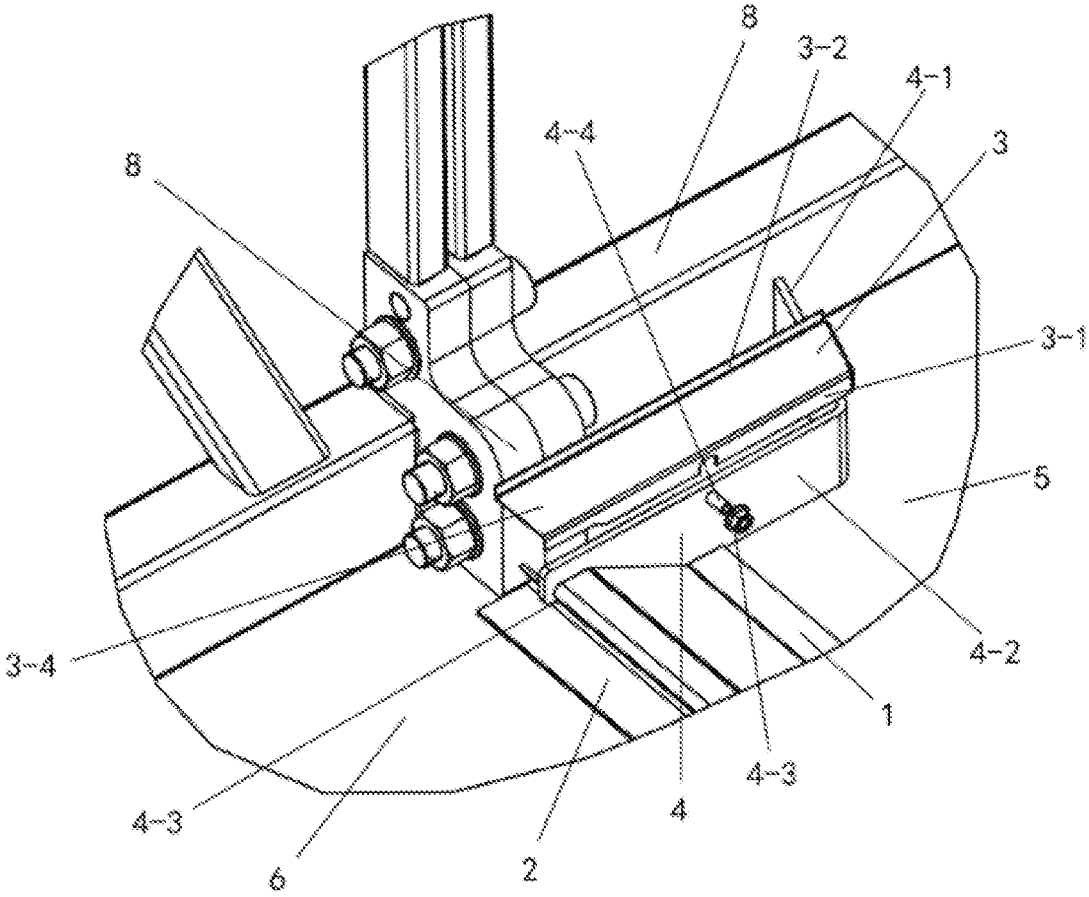
FIG. 2 illustrates an enlarged perspective view of the circled portion in FIG. 1 located on one side of the truss of the escalator or the passenger conveyor.

FIG. 1 illustrates a joint assembly for a truss bottom plate of a truss 8 of an escalator truss or a passenger conveyor according to one embodiment of the present disclosure, the joint assembly is connected between trusses 8 of the escalator or the passenger conveyor opposite to each other. For the sake of brevity, FIG. 2 is taken as an example, which illustrates an enlarged perspective view of the circled portion in FIG. 1 located on one side of the truss 8 of the escalator or passenger conveyor. The truss bottom plate includes a first bottom plate 5 and a second bottom plate 6 adjacent to each other, and an elongated gap (gap) 7 exists at the adjacent position between the first bottom plate 5 and the second bottom plate 6 (see FIG. 7).

The joint assembly includes a first barrier plate 1 and a second barrier plate 2 arranged in the length direction of the gap 7. The first barrier plate 1 is connected with the first bottom plate 5 or integrally formed. The second barrier plate 2 is connected with the second bottom plate 6 or integrally formed.

A part of the first barrier plate 1 is arranged to overlap a part of the second barrier plate 2 and cover the gap 7.

Figure 3:
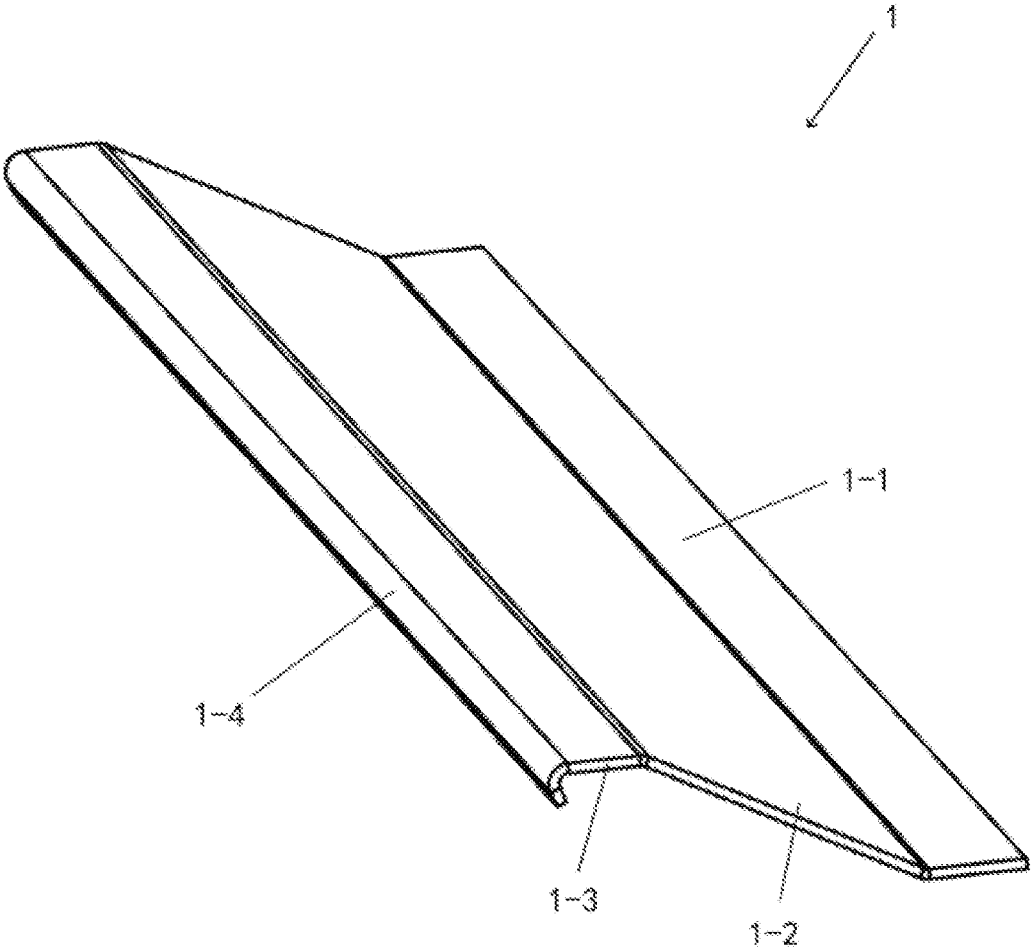
FIG. 3 illustrates a perspective view of a first barrier plate according to the present disclosure.

According to the above embodiment of the present disclosure, as illustrated in FIG. 3, the first barrier plate 1 is a bent sheet metal member and includes a first barrier plate first portion 1-1, a first barrier plate second portion 1-2, a first barrier plate third portion 1-3 and a first barrier plate fourth portion 1-4.

The first barrier plate first portion 1-1 is connected with the first bottom plate 5.

The first barrier plate second portion 1-2 is connected between the first barrier plate third portion 1-3 and the first barrier plate first portion 1-1 and is inclined relative to the first barrier plate third portion 1-3 and the first barrier plate first portion 1-1.

Figure 7:
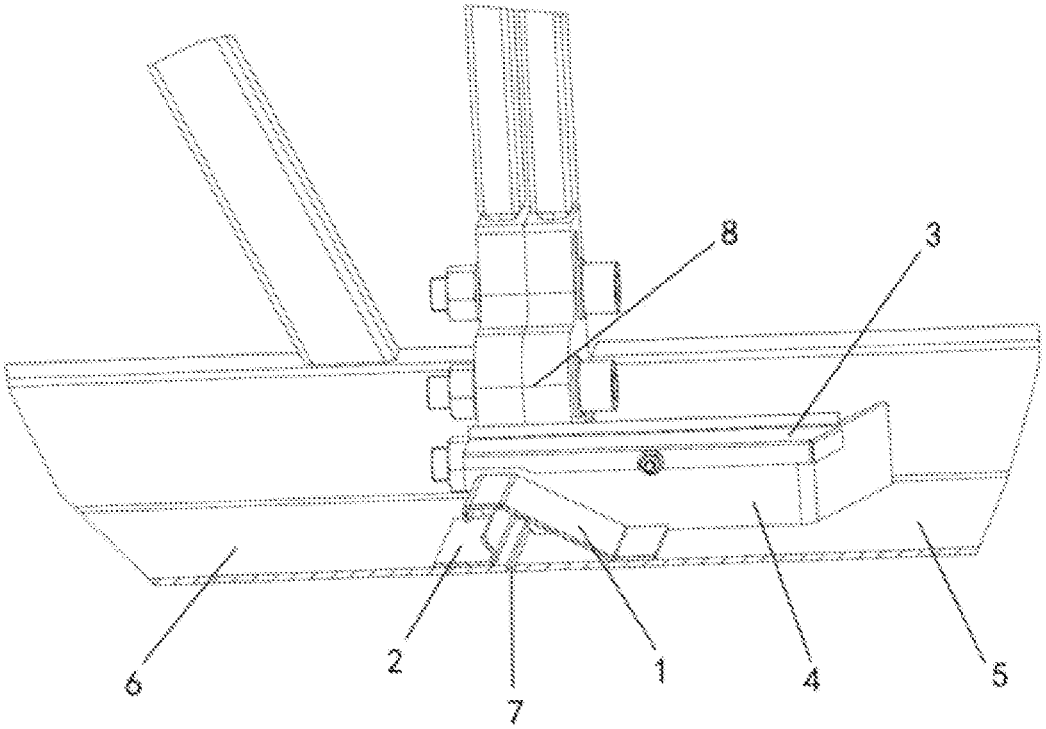
FIG. 7 illustrates a section view of a joint assembly according to the present disclosure.

The first barrier plate fourth portion 1-4 is bent from the edge of the first barrier plate third portion 1-3 towards the second barrier plate 2 (see FIG. 7).

Figure 4:
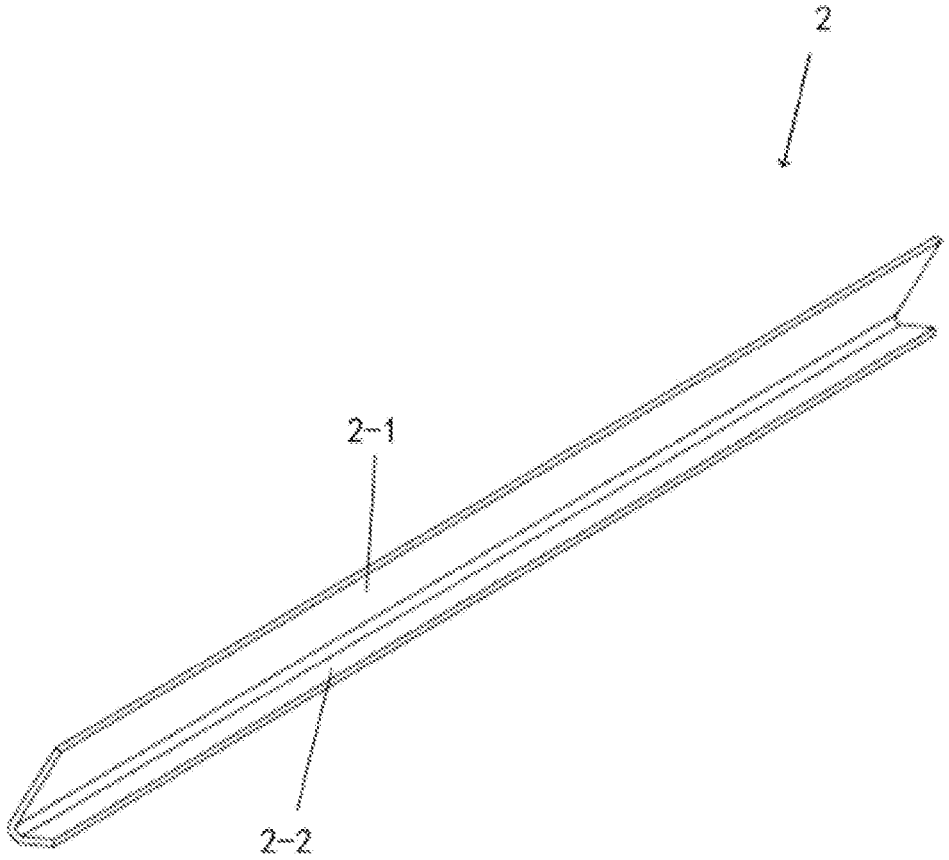
FIG. 4 illustrates a perspective view of a second barrier plate according to the present disclosure.

According to the above embodiments of the present disclosure, as illustrated in FIG. 4, the second barrier plate 2 is a bent sheet metal member and includes a second barrier plate first portion 2-1 and a second barrier plate second portion 2-2.

The second barrier plate second portion 2-2 is bent relative to the second barrier plate first portion 2-1.

The second barrier plate first portion 2-1 is connected with the second bottom plate 6.

The width of the second barrier plate second portion 2-2 is smaller than the width of the first barrier plate second portion 2-1.

According to the above embodiments of the present disclosure, the first barrier plate fourth portion 1-4 extends towards a bent opening between the second barrier plate first portion 2-1 and the second barrier plate second portion 2-2.

The bent opening is open towards a direction away from the gap 7.

According to the above embodiments of the present disclosure, in the length direction of the second barrier plate 2, the two ends of the second barrier plate 2 are respectively connected with the trusses 8 of the escalator or passenger conveyor for supporting the truss bottom plate by welding.

The first barrier plate first portion 1-1 is connected with the first bottom plate 5 by welding or integrally formed.

The second barrier plate first portion 2-1 is connected with the second bottom plate 6 by welding or integrally formed.

According to the above embodiments of the present disclosure, the joint assembly further includes an oil guide plate 4.

Figure 5:
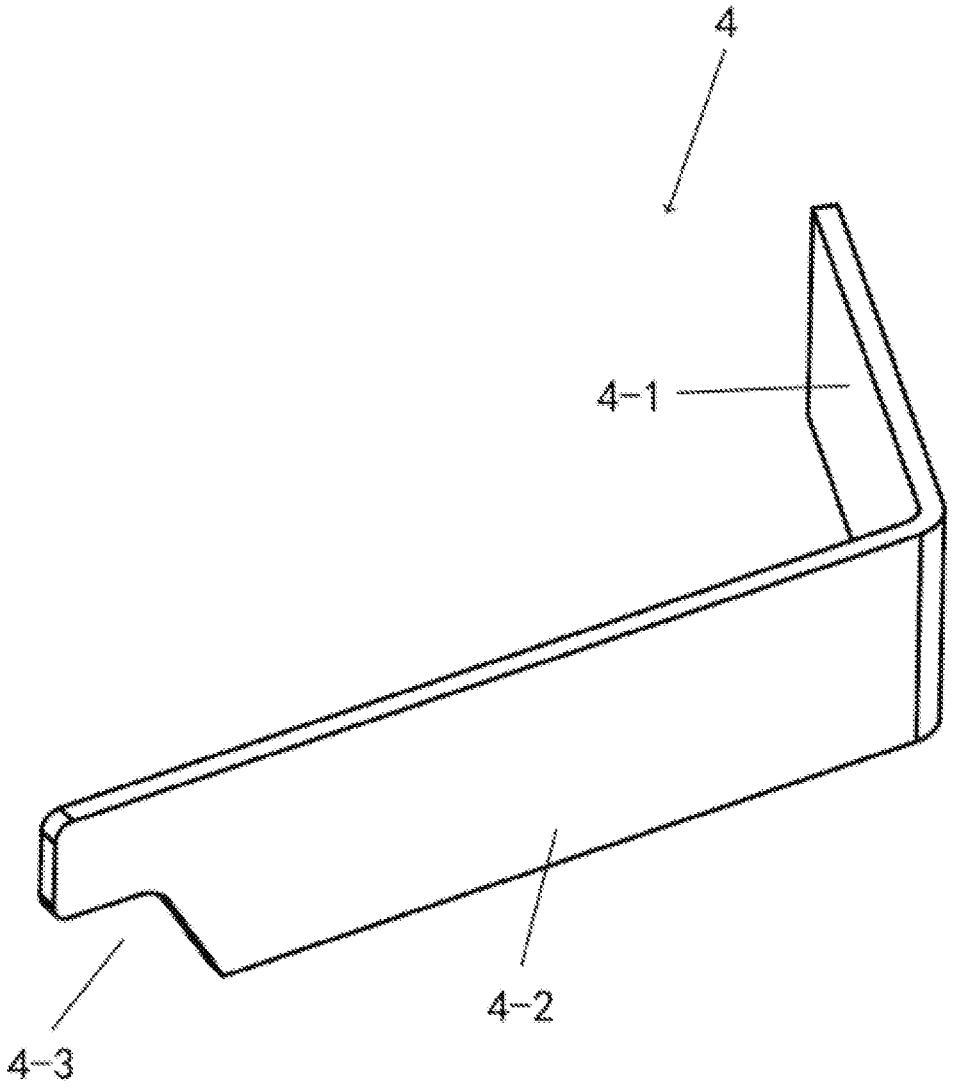
FIG. 5 illustrates a perspective view of an oil guide plate according to the present disclosure.

As illustrated in FIG. 5, the oil guide plate 4 includes an oil guide plate first portion 4-1 and an oil guide plate second portion 4-2 that are bent in an L shape relative to each other.

As illustrated in FIGS. 2 and 5, the oil guide plate first portion 4-1 is connected with the truss 8 of the escalator or passenger conveyor and the first bottom plate 5 by welding.

The oil guide plate second portion 4-2 is connected with the first bottom plate 5 by welding.

In the length direction of the first barrier plate 1, two ends of the first barrier plate 1 are respectively connected with the oil guide plate second portion 4-2 by welding (see FIG. 2).

According to the above embodiments of the present disclosure, the oil guide plate 4 further includes an oil guide plate notch 4-3 arranged in the oil guide plate second portion 4-2.

In the length direction of the second barrier plate 2, two ends of the second barrier plate 2 pass through the oil guide plate notch 4-3 (for example, as illustrated in FIG. 2, one end of the second barrier plate 2 passes through the oil guide plate notch 4-3).

According to the above embodiments of the present disclosure, the oil guide plate 4 further includes a connection stud 4-4 (as illustrated in FIG. 2) arranged on the oil guide plate second portion 4-2.

According to the above embodiments of the present disclosure, the joint assembly further includes an oil barrier plate 3. The oil barrier plate 3 is connected to the truss 8 of the escalator or passenger conveyor by, for example, but not limited to, welding and is located above the first barrier plate 1 and the second barrier plate 2, so as to cover the gap 7.

Figure 6:
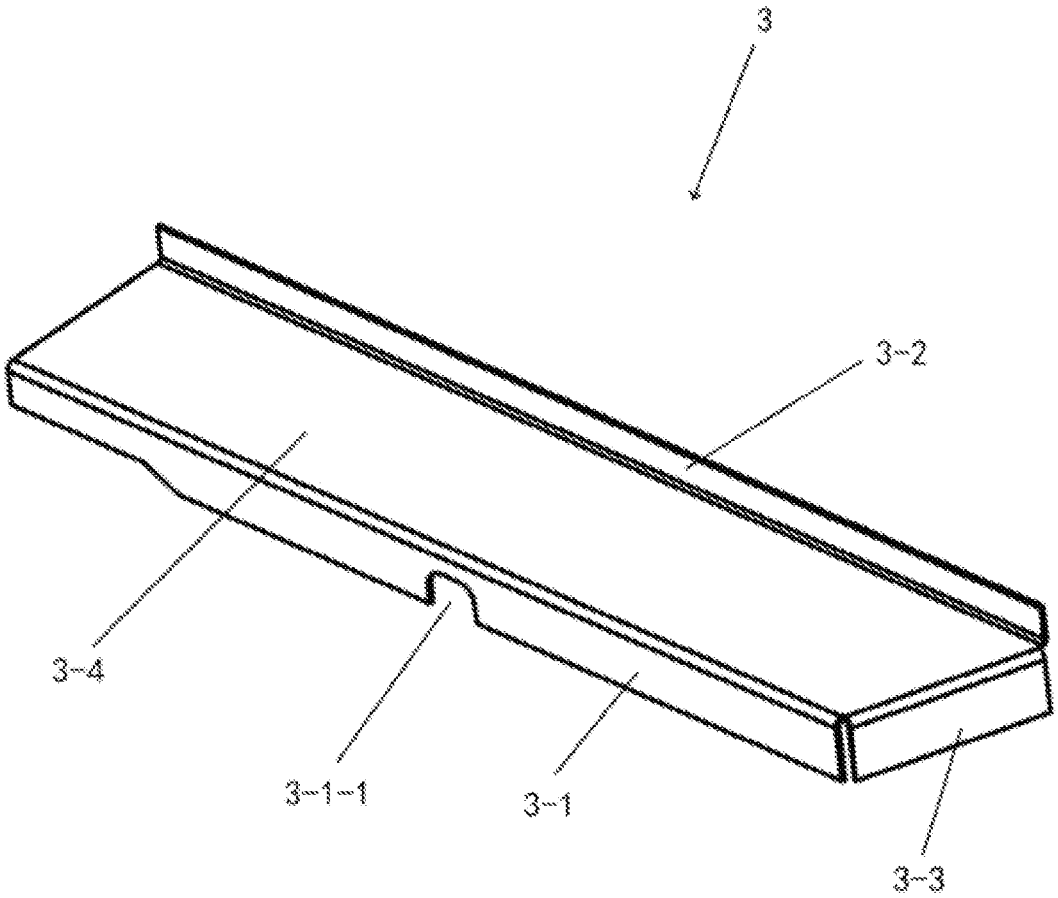
FIG. 6 illustrates a perspective view of an oil barrier plate according to the present disclosure.

Specifically, as illustrated in FIG. 6, the oil barrier plate 3 includes an oil barrier plate body 3-4, and an oil barrier plate first portion 3-1, an oil barrier plate second portion 3-2 and an oil barrier plate third portion 3-3 which are bent and extended relative to the oil barrier plate body 3-4.

The oil barrier plate second portion 3-2 is connected to the truss 8 of the escalator or passenger conveyor by welding.

The oil barrier plate first portion 3-1 is L-shaped relative to the oil barrier plate third portion 3-3, so that the oil barrier plate first portion 3-1 and the oil barrier plate third portion 3-3 are respectively matched on the edges of the oil guide plate second portion 4-2 and the oil guide plate first portion 4-1 which are L-shaped.

The length of the oil barrier plate first portion 3-1 is substantially equal to the length of the oil guide plate second portion 4-2.

At the two ends of the second barrier plate 2 in the length direction, the oil barrier plate body 3-4 covers the gap 7 between the truss 8 of the escalator or passenger conveyor and the oil guide plate second portion 4-2. Of course, those skilled in the art can understand that if the size of the oil barrier plate 3 is large enough, the oil guide plate 4 is not necessary.

According to the above embodiments of the present disclosure, an oil barrier plate notch 3-1-1 is arranged on the oil barrier plate first portion 3-1.

When the oil barrier plate 3 is matched on the oil guide plate 4, the connection stud 4-4 passes through the oil barrier plate notch 3-1-1, so that the oil barrier plate 3 can be fixed on the oil guide plate 4 through the matching of a fastening nut 4-5 and the connection stud 4-4.

According to the joint assembly of the present disclosure, the first barrier plate 1 and the second barrier plate 2 are both bent sheet metal members and are oil-tight welded with the truss 8 of the escalator or passenger conveyor. The oil barrier plate 3 is also a bent sheet metal member fixed on the truss of the escalator or passenger conveyor. By combining the first barrier plate 1 and the second barrier plate 2 with height difference into a lap joint type (forming a labyrinth-like sealing structure), lubricating oil can flow along the outer surface of the first barrier plate 1 to the bottom of the elevator, while the second barrier plate 2 (the second barrier plate second portion 2-2) can prevent the backflow of lubricating oil, thereby preventing the leakage of lubricating oil from the gap 7. The oil barrier plate 3 can prevent leakage of lubricating oil dripping from the upper chain from the gap 7. According to the present disclosure, the joint assembly has no risk of oil leakage; sealant is not needed; and there is no aging problem of sealant.

According to another embodiment of the present disclosure, a truss 8 of an escalator or a passenger conveyor is provided, the truss 8 of the escalator and passenger conveyor includes the joint assembly as described in the above embodiments. The truss 8 of the escalator or passenger conveyor includes a truss bottom plate, the truss bottom plate includes a first bottom plate 5 and a second bottom plate 6 adjacent to each other, a gap 7 exists at the adjacent position between the first bottom plate 5 and the second bottom plate 6, and the joint assembly is arranged to cover the gap 7.

The foregoing disclosure provides illustration and description, but is not intended to be exhaustive or to limit embodiments to the precise form disclosed. Modifications and variations can be made in light of the above disclosure, or can be obtained from the practice of the embodiments.

Even though specific combinations of features are recited in the claims and/or disclosed in the specification, these combinations are not intended to limit the disclosure of various embodiments. In fact, many of these features can be combined in a manner not specifically recited in the claims and/or not specifically disclosed in the specification. Although each dependent claim listed below may directly depend on only one claim, the disclosure of various embodiments includes each dependent claim combined with each other claim in the claim set.

Unless explicitly stated, any element, action or instruction used herein should not be interpreted as critical or necessary. In addition, as used herein, the articles "a" and "an" are intended to include one or more items, and may be used interchangeably with "one or more". Furthermore, as used herein, the articles "the" and "this" are intended to include one or more items cited in conjunction with the articles "the" and "this" and may be used interchangeably with "one or more". Furthermore, as used herein, the term "set" is intended to include one or more items (e.g., related items, unrelated items, combinations of related and unrelated items, etc.), and can be used interchangeably with "one or more". In case only one item is intended, use the phrase "only one item" or similar language. In addition, as used herein, the term "having", variations thereof and the like are intended to be open terms. Furthermore, the phrase "based on" is intended to mean "based at least in part" unless explicitly stated otherwise. In addition, as used herein, the term "or" is intended to be inclusive when used in series, and may be used interchangeably with "and/or", unless explicitly stated otherwise (e.g., if used in conjunction with "or" or "only one of them").

The invention claimed is:

1. A truss assembly comprising:

a joint assembly configured to connect a truss bottom plate to a truss of an escalator or a passenger conveyor, the truss bottom plate comprising a first bottom plate and a second bottom plate located adjacent to each other, and a gap existing at an adjacent position between the first bottom plate and the second bottom plate;

wherein the joint assembly comprises a first barrier plate and a second barrier plate;

the first barrier plate is connected with the first bottom plate;

the second barrier plate is connected with the second bottom plate; and a part of the first barrier plate is positioned above a part of the second barrier plate and overlaps the part of the second barrier plate and covers the gap such that an open labyrinth sealing structure is formed.

2. The truss assembly according to claim 1, wherein the first barrier plate is a bent sheet metal member and comprises a first barrier plate first portion, a first barrier plate second portion, a first barrier plate third portion and a first barrier plate fourth portion;

the first barrier plate first portion is connected with the first bottom plate;

the first barrier plate second portion is connected between the first barrier plate third portion and the first barrier plate first portion and is inclined relative to the first barrier plate third portion and the first barrier plate first portion;

the first barrier plate fourth portion is bent from an edge of the first barrier plate third portion towards the second barrier plate.

3. The truss assembly according to claim 2, wherein the second barrier plate is a bent sheet metal member and comprises a second barrier plate first portion and a second barrier plate second portion;

the second barrier plate second portion is bent relative to the second barrier plate first portion; the second barrier plate first portion is connected with the second bottom plate;

a width of the second barrier plate second portion is smaller than a width of the second barrier plate first portion.

4. The truss assembly according to claim 3, wherein the first barrier plate fourth portion extends towards a bent opening between the second barrier plate first portion and the second barrier plate second portion;

the bent opening is open towards a direction away from the gap.

5. The truss assembly according to claim 3, wherein in a length direction of the second barrier plate, two ends of the second barrier plate are respectively connected with a truss for supporting the truss bottom plate by welding;

the first barrier plate first portion is connected with the first bottom plate by welding or integrally formed with the first bottom plate;

the second barrier plate first portion is connected with the second bottom plate by welding or integrally formed with the second bottom plate.

6. The truss assembly according to claim 3, wherein the joint assembly further comprises an oil guide plate;

the oil guide plate comprises an oil guide plate first portion and an oil guide plate second portion that are bent in an L shape relative to each other;

the oil guide plate first portion is respectively connected with the truss of the escalator or the passenger conveyor and the first bottom plate by welding;

the oil guide plate second portion is connected with the first bottom plate by welding;

in a length direction of the first barrier plate, two ends of the first barrier plate are respectively connected with the oil guide plate second portion by welding.

7. The truss assembly according to claim 6, wherein the oil guide plate further comprises an oil guide plate notch arranged in the oil guide plate second portion;

in a length direction of the second barrier plate, two ends of the second barrier plate pass through the oil guide plate notch.

8. The truss assembly according to claim 6, wherein the oil guide plate further comprises a connection stud arranged on the oil guide plate second portion.

9. The truss assembly according to claim 6, wherein the joint assembly further comprises an oil barrier plate;

the oil barrier plate is connected to the truss of the escalator or the passenger conveyor and positioned above the first barrier plate and the second barrier plate, so as to cover the gap.

10. The truss assembly according to claim 9, wherein the oil barrier plate comprises an oil barrier plate body and an oil barrier plate first portion, an oil barrier plate second portion and an oil barrier plate third portion which are bent and extended relative to the oil barrier plate body;

the oil barrier plate second portion is connected to the truss of the escalator or the passenger conveyor by welding;

the oil barrier plate first portion is L-shaped relative to the oil barrier plate third portion, so that the oil barrier plate first portion and the oil barrier plate third portion are respectively matched on the edges of the oil guide plate second portion and the oil guide plate first portion which are L-shaped;

a length of the oil barrier plate first portion is equal to a length of the oil guide plate second portion;

at two ends of the second barrier plate in a length direction, the oil barrier plate body covers the gap between the truss of the escalator or the passenger conveyor and the oil guide plate second portion.

11. The truss assembly according to claim 10, wherein an oil barrier plate notch is arranged on the oil barrier plate first portion;

when the oil barrier plate is matched on the oil guide plate, a connection stud arranged on the oil guide plate second portion passes through the oil barrier plate notch, so that the oil barrier plate is configured to be fixed on the oil guide plate through a matching of a fastening nut and the connection stud.

* * * * *